US005806186A

United States Patent [19]

Langman et al.

[11] Patent Number: 5,806,186

[45] Date of Patent: Sep. 15, 1998

[54] COMBINATION FINGER AND TOE NAIL CLIPPERS

[75] Inventors: Kirk Langman, 10354 Wilshire #27, Los Angeles, Calif. 90024; Kenneth Tarlow, Corte Madera, Calif.

[73] Assignee: Kirk Langman, Los Angeles, Calif.

[21] Appl. No.: 873,255

[22] Filed: Jun. 11, 1997

[51] Int. Cl.[6] ..... A45D 29/02

[52] U.S. Cl. ..... 30/28; 132/75.5

[58] Field of Search ..... 30/28; 132/75.4, 132/75.5, 73.5

[56] References Cited

U.S. PATENT DOCUMENTS 2,999,505 9/1961 Herstedt ..... 30/28 X
3,315,354 4/1967 Oates ..... 30/28
4,176,449 12/1979 Lee et al. ..... 30/28

*Primary Examiner*—Douglas D. Watts

[57] ABSTRACT

A combined toe and finger nail clipper having a common metal strip with a toe nail cutting edge at one end and a finger nail cutting edge at the opposite end. Mating nail cutting edges are at the ends of two additional metal strips which are each welded above and below at opposite ends of the common metal strip. A pair of vertical retaining posts located at each end of the nail clipping unit hold lever arms which can be stored in the flat position or rotated around and put into the use position as in conventional nail clippers. In this way a manufacturer can produce a combined toe and finger nail clipper more economically than two separate nail clippers and the user can store the combined nail clipper in a smaller space without worrying about locating two separate clippers.

1 Claim, 1 Drawing Sheet

COMBINATION FINGER AND TOE NAIL CLIPPERS

FIELD OF INVENTION

The present invention relates to nail clippers and more specifically to a combination toe nail and finger nail clipper.

BACKGROUND OF INVENTION

Nail clippers in a variety of designs have been in existence for many years. Nail clippers of different sizes with different size cutting heads have been developed for both toe nails and finger nails. Since toe nails, especially the big toe, tend to be larger than finger nails, a larger clipper has been developed for toe nails whereas a smaller clipper is commonly used for finger nails. Many people are forced to purchase, own and keep track of two nail clippers. It would appear that there is a need for a single nail clipper which performs both functions of a toe nail clipper and a finger nail clipper and is less expensive to manufacture than two separate nail clippers.

OBJECT AND SUMMARY OF THE PRESENT INVENTION

It is the object of the present invention to solve the above stated problem by providing a single nail clipper which has a toe nail cutting head at one end and a finger nail cutting head at the opposite end. This is accomplished by providing a sharpened nail cutting edge at either end of a first flat metal strip. A small finger nail clipping cutting edge is at one end and a larger toe nail cutting edge is at the opposite end. A second metal strip is welded at one end to the first metal strip. The second metal strip has a toe nail cutting edge at the opposite end. The first and second strip form a V shape with the bottom of the V being the welded end and the top of the V being the toe nail cutting end where the toe nail cutting edges face each other. A third metal strip is welded to the first metal strip on the opposite side to the second metal strip. This third strip has a finger nail cutting edge at one end and faces a mating finger nail cutting edge located at one end of the first metal strip. Vertical posts are located at each end of the nail clipping assembly and a swingable lever like arm is fastened to each vertical post and operate in typical nail clipper fashion where in one position the lever arm lays flat against the main body of the clipper and when swung and flipped forms a lever arm for applying pressure to the free moving cutting blade. In this way the present invention provides a new and improved nail clipping device which combines a toe nail clipper and a finger nail clipper which can be manufactured more economically than two separate nail clippers and which also is more convenient for a person to store and use. The drawings below show a detailed description of the preferred embodiment, however, it is to be understood that there may be other embodiments which differ somewhat from the preferred embodiment but which, never the less, are embodied within the spirit of the present invention and would be obvious to one versed in the stated of the art.

GENERAL DESCRIPTION OF THE DRAWINGS

DETAILED DESCRIPTION OF THE DRAWINGS

Figure 1:
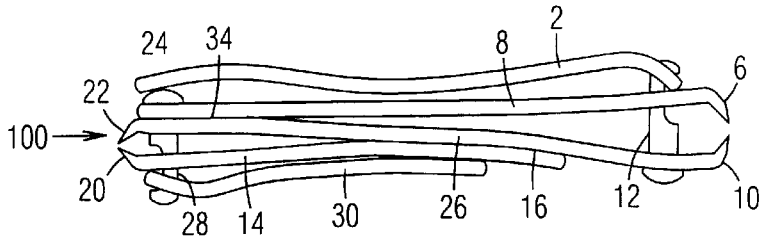
FIG. 1 is a side view of the nail clippers of the present invention in the non-use position.

Referring now to FIG. 1 there is shown a side view of the nail clipper 100 of the present invention. The present invention 100 uses typical nail clipper construction however the central metal strip 26 has a cutting edge on both ends. The left end of nail clipper assembly 100 has a matching set of finger nail clipping surfaces 22, 20 and the right end has a matching set of toe nail clipping surfaces 6, 10. Metal strip 8 is welded at one end to central strip 26 as shown at point 34. Strip 8 terminates at its opposite end in cutting edge 6. Metal strip 14 is welded to the bottom surface of central strip 26 as shown at point 16. Vertical post 12 retains the lever arm 2 of toe nail cutting portion. Vertical post 28 retains the lever arm 30 of finger nail cutting portion.

Figure 2:
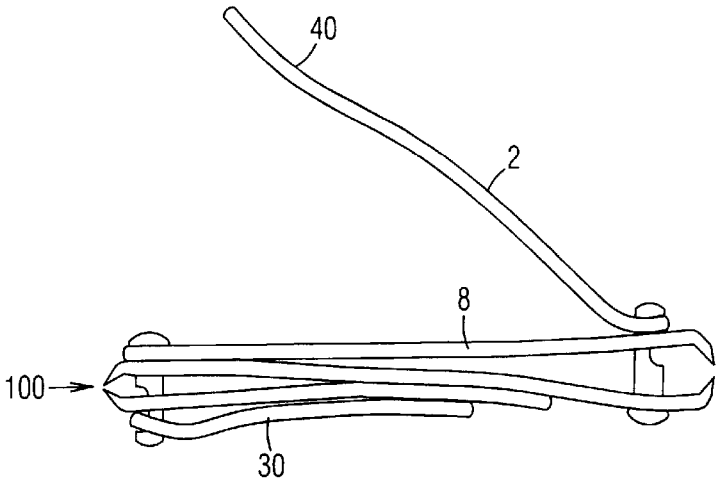
FIG. 2 is a side view of the nail clippers of the present invention with the toe nail clipper portion in the use position.

FIG. 2 shows a side view of the nail clippers of the present invention with toe nail cutting lever arm 2 in the use position as found in conventional nail clippers. The user puts his or her thumb on lever 2 at position 40 and puts his or her forefinger on stored lever arm 30. By pressing the two arms 2, 30 together the user can trim his or her toe nails.

Figure 3:
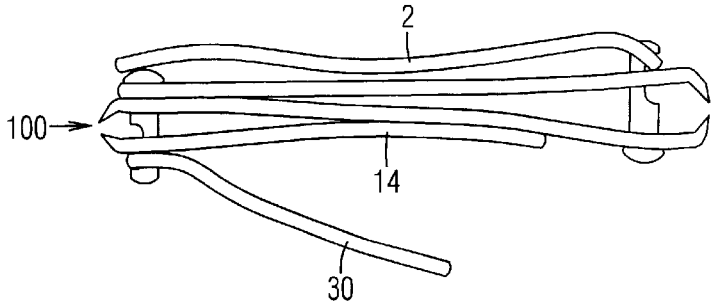
FIG. 3 is a side view of the nail clippers of the present invention with the finger nail clipper portion in the use position.

FIG. 3 shows a side view of the nail clippers of the present invention with the finger nail cutting lever arm 30 in the use position as found in conventional nail clippers. The user puts his or her thumb at the free end of lever arm 30 and his or her forefinger on stored lever arm 2. By pressing the two arms 2, 30 together the user can trim his or her finger nails.

In this way a person can cut his or her finger nails or toe nail with a single, unique, combined toe and finger nail clipper which is more economical to manufacture and more convenient to store and use than two separate toe and finger nail clippers Therefore I claim:

1. An improved nail clipper, comprising:

rigid metal first strip terminating at one end in an upwardly facing toenail cutting edge and at an opposite end in a downwardly facing fingernail cutting edge;

a rigid metal second strip having one end attached to said first strip near said fingernail cutting edge and extending toward said toenail cutting edge of said first strip, said second strip having an opposite end terminating in a downwardly facing toenail cutting edge springily engaging with said upwardly facing toenail cutting edge of said first strip; and a rigid metal third strip having one end attached to said first strip near said toenail cutting edge and extending toward said fingernail cutting edge of said first strip, said third strip having an opposite end terminating in an upwardly facing fingernail cutting edge springily engaging with said downwardly facing fingernail cutting edge of said first strip;

a first vertical shaft retaining said toenail cutting edge of said first strip and said toenail cutting edge of said second strip, said first vertical shaft also retaining a first lever arm; and a second vertical shaft retaining said fingernail cutting edge of said first strip and said fingernail cutting edge of said third strip, said second vertical shaft also retaining a second lever arm.

* * * * *